United States Patent [19]

Williams

[11] Patent Number: 4,590,634

[45] Date of Patent: May 27, 1986

[54] MARINE TRANSFER DEVICE

[75] Inventor: John W. Williams, Bellevue, Wash.

[73] Assignee: The Boeing Company, Seattle, Wash.

[21] Appl. No.: 684,267

[22] Filed: Dec. 20, 1984

[51] Int. Cl.[4] ..... E01D 1/00

[52] U.S. Cl. ..... 14/71.1; 114/230; 182/2; 14/27; 414/137

[58] Field of Search ..... 14/1, 27, 69.5, 71, 14/71.1, 71.3, 71.5; 414/137, 138, 139; 114/230; 182/1, 2, 48, 97

[56] References Cited

U.S. PATENT DOCUMENTS

| | | | |
|---|---|---|---|
| 1,091,835 | 3/1914 | Goss | 14/71.1 |
| 2,641,785 | 6/1953 | Pitts et al. | 14/71.1 |
| 2,803,841 | 8/1957 | Wellens | 14/71.1 |
| 3,004,391 | 10/1961 | Miller | 14/71.1 X |
| 3,008,158 | 11/1961 | Stinson | 14/71.1 |
| 3,228,051 | 1/1966 | Voase et al. | 14/71.1 |
| 3,274,629 | 9/1966 | Gearon et al. | 14/71.1 |
| 3,426,719 | 2/1969 | Mizell | 114/230 |
| 3,731,761 | 5/1973 | Glenn | 182/1 |
| 4,003,473 | 1/1977 | Ryan | 214/14 |
| 4,011,615 | 3/1977 | Maxson et al. | 14/71.1 |
| 4,035,861 | 7/1977 | Edge | 14/71.1 |
| 4,043,288 | 8/1977 | Vulovic | 114/270 |
| 4,133,283 | 1/1979 | Ryan | 114/230 |
| 4,142,640 | 3/1979 | Kummerman | 414/139 |
| 4,157,742 | 6/1979 | Aanensen | 182/97 |
| 4,162,551 | 7/1979 | Serrano | 14/69.5 |
| 4,169,296 | 10/1979 | Wipkink et al. | 14/71.1 |

FOREIGN PATENT DOCUMENTS

| | | | |
|---|---|---|---|
| 353257 | 8/1931 | United Kingdom | 14/71.1 |
| 1236447 | 6/1971 | United Kingdom | 14/71.1 |

*Primary Examiner*—Stephen J. Novosad
*Assistant Examiner*—John F. Letchford
*Attorney, Agent, or Firm*—Christensen, O'Connor, Johnson & Kindness

[57] ABSTRACT

Disclosed is a marine transfer device (10) having a ramp (18) which is connected at its inboard end to a stationary offshore platform (14) by a mount assembly (28) that allows the ramp to pivot about horizontal and vertical axes and restrains torsional ramp movement. The outboard end of the ramp (18) includes a landing pad (22) and support frame (26) which support the outboard end of the ramp on a ship's deck or similar surface when the transfer device is lowered into position by a crane or service derrick. A movable carriage assembly (20), which is located between the support frame (26) and the outboard end of the ramp (18), extends and retracts as the movement of the ship causes the support frame (26) to move away from and toward the ramp. Stairs (24) extend from the support frame to the ship's deck. The carriage assembly (20) provides a continuous, stable surface for the passage of personnel from the stairs to the ramp. A ball and socket joint (114), which connects the landing pad 22 to the support frame (26) eliminates the transfer of rolling and pitching motions from the deck to the carriage assembly (20) and ramp (18).

7 Claims, 11 Drawing Figures

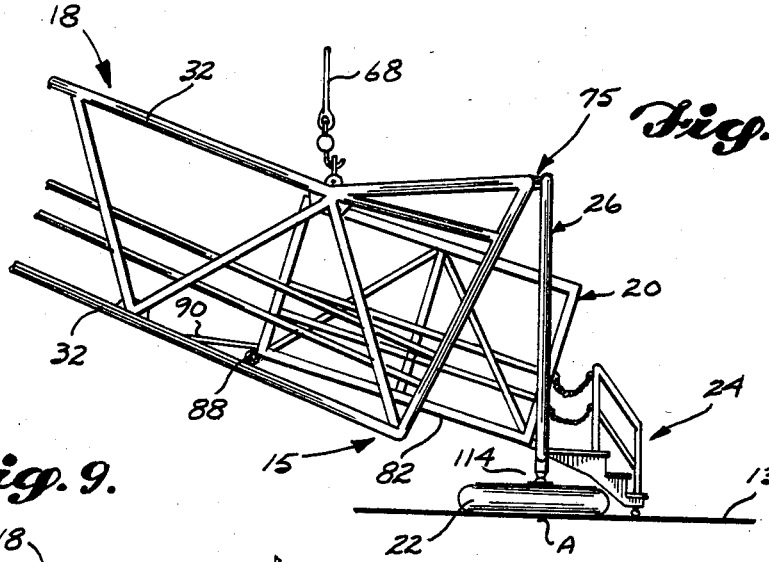
Fig. 8.
Fig. 9.
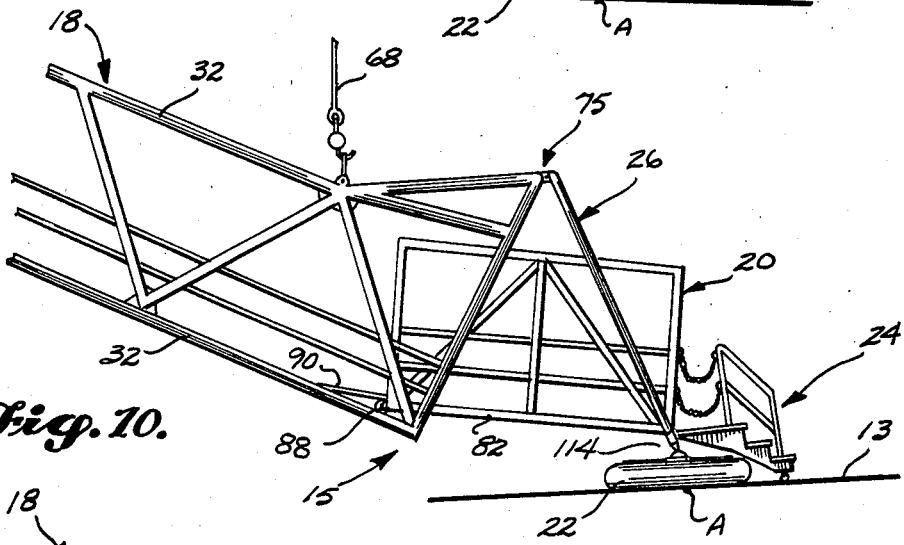
Fig. 10.
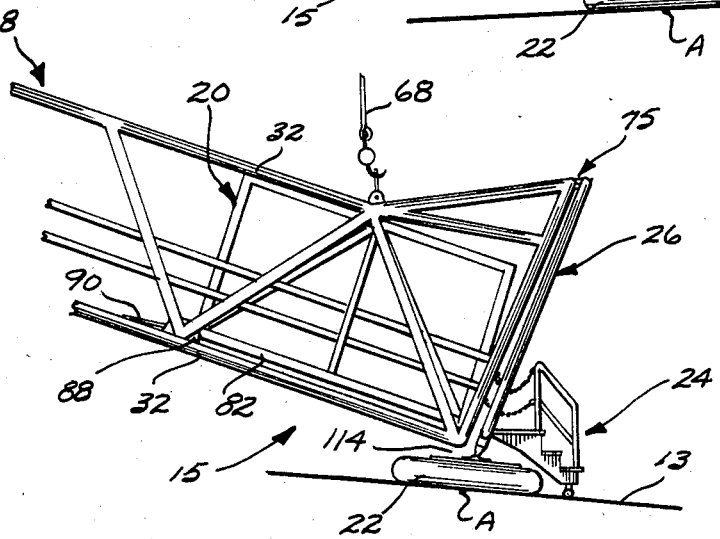

MARINE TRANSFER DEVICE

BACKGROUND OF THE INVENTION

This invention relates to devices for transferring persons or material between a stationary object, such as an offshore platform, and a moving object, such as a ship.

Oil rigs and drilling platforms are serviced by the regular transfer of operating personnel from supply vessels to the platforms, and vice versa, in virtually all weather conditions. Typical marine transfer devices utilize a crane or service derrick that is mounted to the offshore platform to lower a gangway or ramp to an adjacently moored ship.

When transferring personnel or material between the platform and the ship, the safety and efficiency of the operation can be greatly hampered by adverse weather or sea conditions. A common problem encountered with prior art transfer devices is easily and securely coupling the device to a ship that may be rolling, pitching or surging in response to wave action at the platform site. Further, when a prior art device is connected, the motion of the ship usually is transmitted to the transfer device, making negotiation difficult and potentially hazardous.

The use of current marine transfer devices most generally is restricted to vessels that have undergone the modifications necessary for connection with the transfer device. These modifications typically include reinforcing the ship's structure and attaching a receptacle to the ship's deck for receiving the outboard end of the device.

Pitts et al., U.S. Pat. No. 2,641,785, which is typical of prior proposals for marine transfer devices, discloses a marine transfer ramp, the operation of which involves directing a ball point on the end of the ramp into a cup that is attached to the deck of the ship. Although this arrangement may be satisfactory under some conditions, effecting this type of connection under conditions where the ship is thrashing about its moorings can be difficult and time-consuming.

Ryan, U.S. Pat. No. 4,003,473, which also illustrates the prior art, discloses a combined marine ramp transfer and mooring system that is connected to the ship by threading a hang line (which is attached to the ramp) through a docking pedestal that is mounted to the ship's deck. The end of the ramp is then drawn toward the pedestal so that a ramp attacher assembly can be latched thereto. Ryan's system is designed so that the ships rolling motion is transmitted to the ramp, resulting in twisting movement of the ramp. Ryan also calls for reinforcing the ship's structure in order to accommodate the forces that are placed on the docking pedestal.

SUMMARY OF THE INVENTION

This invention provides a marine transfer device for transferring personnel or material between a stationary object, such as an offshore platform, and a moving object, such as a ship, with relative safety and efficiency. The marine transfer device made in accordance with this invention includes a ramp that has an inboard end and an outboard end, a walkway and sides. The inboard end of the ramp is hingedly attached to the platform in a manner that allows the ramp to swing both vertically and horizontally. The ramp is moved by a service derrick or crane so that the outboard end of the ramp is positioned near the deck of the ship. A frame, which is pivotally connected to the outboard end of the ramp, extends below the walkway of the ramp and is connected by a ball and socket joint to an inflated landing pad. The ramp is lowered by the service derrick so that the landing pad rests on the deck of the ship. The frame and landing pad thereby support the outboard end of the ramp.

A movable carriage assembly having an inboard end, an outboard end and a floor extends from the outboard end of the ramp toward the deck of the ship. The outboard end of the carriage assembly is attached to the frame. Stairs extend downwardly to the surface of the ship's deck from the portion of the frame that is connected to the carriage. Contact between the stairs and the deck is made by a single caster mounted on the lowest portion of the stairs. Wheels are attached to the inboard end of the carriage assembly floor so that the end can freely roll along the walkway of the ramp.

A marine transfer device formed in accordance with this invention will not be subject to the previously described problems. Specifically, the inflated landing pad eliminates the difficulty of precisely coupling the ramp to a ship that is rolling, pitching, or surging at it rides the waves. The pad is landed anywhere within a flat target area on the ship's deck. It can be appreciated that a marine transfer device made in accordance with this invention offers considerably flexible operation over a wide range of ship designs with which it can be used. Furthermore, the device can be quickly disengaged from the ship in the event of an emergency.

As an aspect of this invention, the movable carriage assembly operates in conjunction with the frame and landing pad so that as the ship pitches or surges, the carriage will extend and retract from the outboard end of the ramp in order to maintain a continuous, substantially planar inclined path from the stairs to the walkway of the ramp.

As another aspect of this invention, the inflated landing pad is sized so that it will buoyantly support the device in the water if, for example, in an emergency, the ship is suddenly moved away from the platform. Furthermore, since the ramp loads are distributed over the relatively large area of the pad there is no need for special reinforcement of the ship's structure.

As still another aspect of this invention, the ball and socket joint connection between the landing pad and the frame substantially eliminates the transfer of the ship's rolling and pitching motion to the ramp. This invention thus provides a marine transfer device that is easily coupled between an offshore platform and an adjacently moored ship while offering a stable, substantially planar path for easy transfer of personnel between the ship and the platform.

BRIEF DESCRIPTION OF THE DRAWINGS

FIGS. 8–10 are side elevation views illustrating the manner by which the invention accommodates surging and pitching of the ship.

DESCRIPTION OF THE PREFERRED EMBODIMENT

Figure 1:
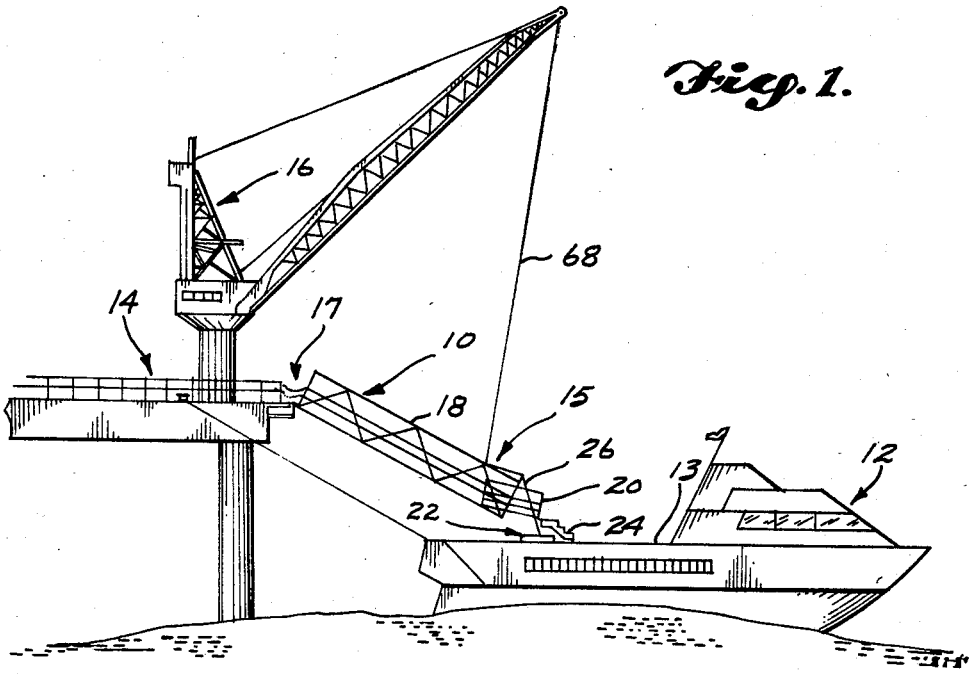
FIG. 1 is a side elevational view of a marine transfer device formed in accordance with the invention and extending between an offshore platform and a ship.

With reference to FIG. 1, the marine transfer device 10 formed in accordance with this invention is used for transferring persons or material between a stationary object, such as an offshore platform 14, and an object, such as a ship 12, that is moving with respect to the platform 14. The transfer device 10 is generally comprised of a ramp 18 which is extendable outwardly and downwardly from platform 14; a carriage assembly 20 and stairs 24, which form the outboard end 15 of the transfer device 10; a landing pad 22 which supports the outboard end 15 of the transfer device at the deck 13 of the ship 12; and a support frame 26, which interconnects landing pad 22 with carriage assembly 20 and stairs 24. In the following description, the adjective "inboard" refers to any part of the marine transfer device that is either nearer to the platform than it is to the ship, or faces the platform as opposed to the ship. Conversely, any "outboard" part of the device is a part that is farther from the platform than the ship, or faces toward the ship and away from the platform.

As can be seen from FIG. 1, a service derrick 16 and hoist line 68 are utilized to position the outboard end 15 of the ramp 18 over the deck 13 of ship 12 and lower the outboard end of transfer device 10 to the ship, so that the landing pad 22 rests on the deck 13 of ship 12. With the transfer device 10 positioned in this manner, the carriage assembly 20 extends outwardly from the ramp 18. The top of stairs 24 is hingedly attached to the outboard end of a carriage assembly 20. The lower end of the stairs rest on the deck 13 of the ship 12. As shall be described in more detail, the landing pad 22, support frame 26, carriage assembly 20, and stairs 24, are structured and arranged to collectively provide access to the ramp 18 from deck 13, and to maintain that access despite the various movements of the ship with respect to the ramp 18.

Figure 2:
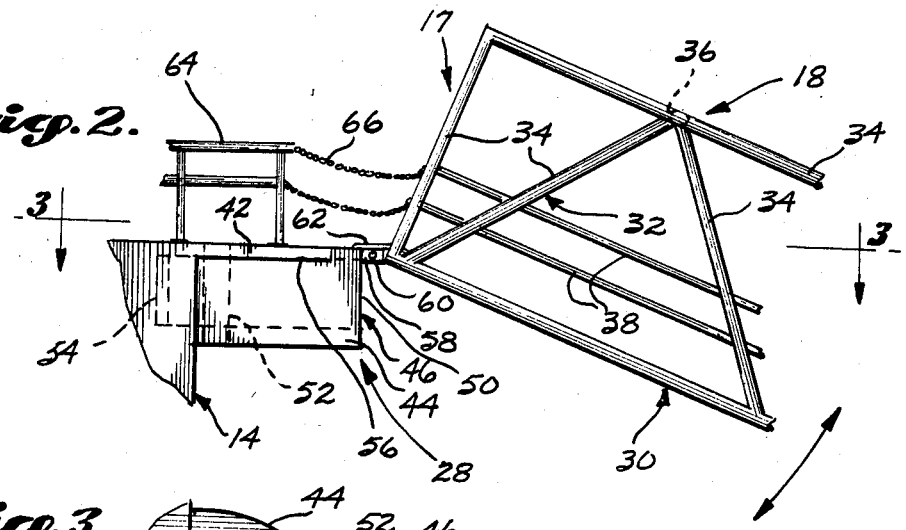
FIG. 2 is a side elevational view of the inboard end of the marine transfer device, illustrating the connection thereof.
Figure 3:
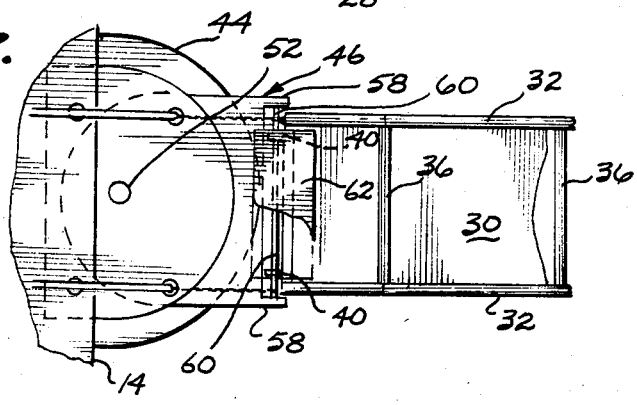
FIG. 3 is a top sectional view taken along lines 3—3 in FIG. 2.

The specific components of the marine transfer device and its deployment will now be described. With reference to FIGS. 2 and 3, the inboard end 17 of ramp 18 is connected to the offshore platform 14 by mount assembly 28. In the depicted arrangement, ramp 18 consists of a planar walkway 30 having sides 32 extending upwardly from and perpendicular to the edges of the walkway. Walkway 30 can be formed of any suitable material and preferably a slip resistant surface. Slides 32 are generally formed of tubular structural elements 34 that are fastened at their ends to form simple planar trusses. A plurality of cross braces 36 extend between the tops of sides 32 at spaced locations. A pair of parallel siderails 38 are fastened to each side 32 and extend from one end of the ramp to the other.

As previously mentioned, the inboard end 17 of ramp 18 is connected to the platform 14 by mount assembly 28. Specifically, mount assembly 28 comprises a pivot plate 46 that is sandwiched between an upper and lower support 42 and 44, respectively. Both upper support 42 and lower support 44 are substantially semicircular-shaped in plan view and project outwardly from the platform 14 in parallel spaced apart relationship. The radius of lower support 44 is slightly larger and therefore extends further from the platform 14 than does upper support 42. In plan view, pivot plate 46 is D-shaped with its curved end extending into a rectangular-shaped recess 54 that is formed in platform 14. A vertically extending pin 52, having one end secured in the upper support bracket 42 and its other end secured in the lower support bracket 44, passes through pivot plate 46 to permit horizontal swinging movement of the transfer device 10 about its inboard end 17. A recess 56 is formed in the upper surface of pivot plate 46 and is shaped so that upper support 42 is seated therein. Thus, contiguous portions of the upper surface of the pivot plate 46 and the upper surface of upper bracket 42 are in substantially the same horizontal plane.

To allow vertical swinging movement of transfer device 10 about mounting assembly 28, the outboard facing flat side 50 of D-shaped pivot plate 46 is pivotally attached to the terminus of ramp 18. Specifically, a flange 58 extends outwardly from each outboard corner of pivot plate 46. A flange 40, which extends from each inboard corner of walkway 30, passes along the inner surface of each flange 58 of mount 40. A rod 60 extends between flanges 58 and passes through openings in flanges 40 to allow the inboard end of the ramp 18 to pivot about the horizontal axis defined by pin 60. Preferably, a flexible cover plate 62 is fastened over the area where walkway 30 is joined to pivot plate 46 to provide a continuous surface for walking or material movement. A chain link handrail 66 extends between ramp siderails 38 and platform-mounted handrails 64.

With reference to FIGS. 1, 2 and 3, and in light of the structure just described, it can be recognized that the transfer device 10 can be swung from side to side by the hoist 68 of the service derrick 16 until it is properly aligned with the deck 13 of ship 12. Specifically, the transfer device 10 is swung about a vertical axis defined by pin 52 in the mount assembly 28. When properly aligned with the deck of the ship 12, the device can then be lowered until landing pad 22 rests upon deck 13. During upwardly and downwardly swinging movement of the transfer device 10, the ramp 18 pivots at its inboard end about the horizontal axis defined by rod 60 in the mount assembly 28. It is pointed out that although the mount assembly 28 allows motion of the ramp about a vertical and/or horizontal axis, the ramp is restrained from torsional motion.

Figures 4A, 4B:
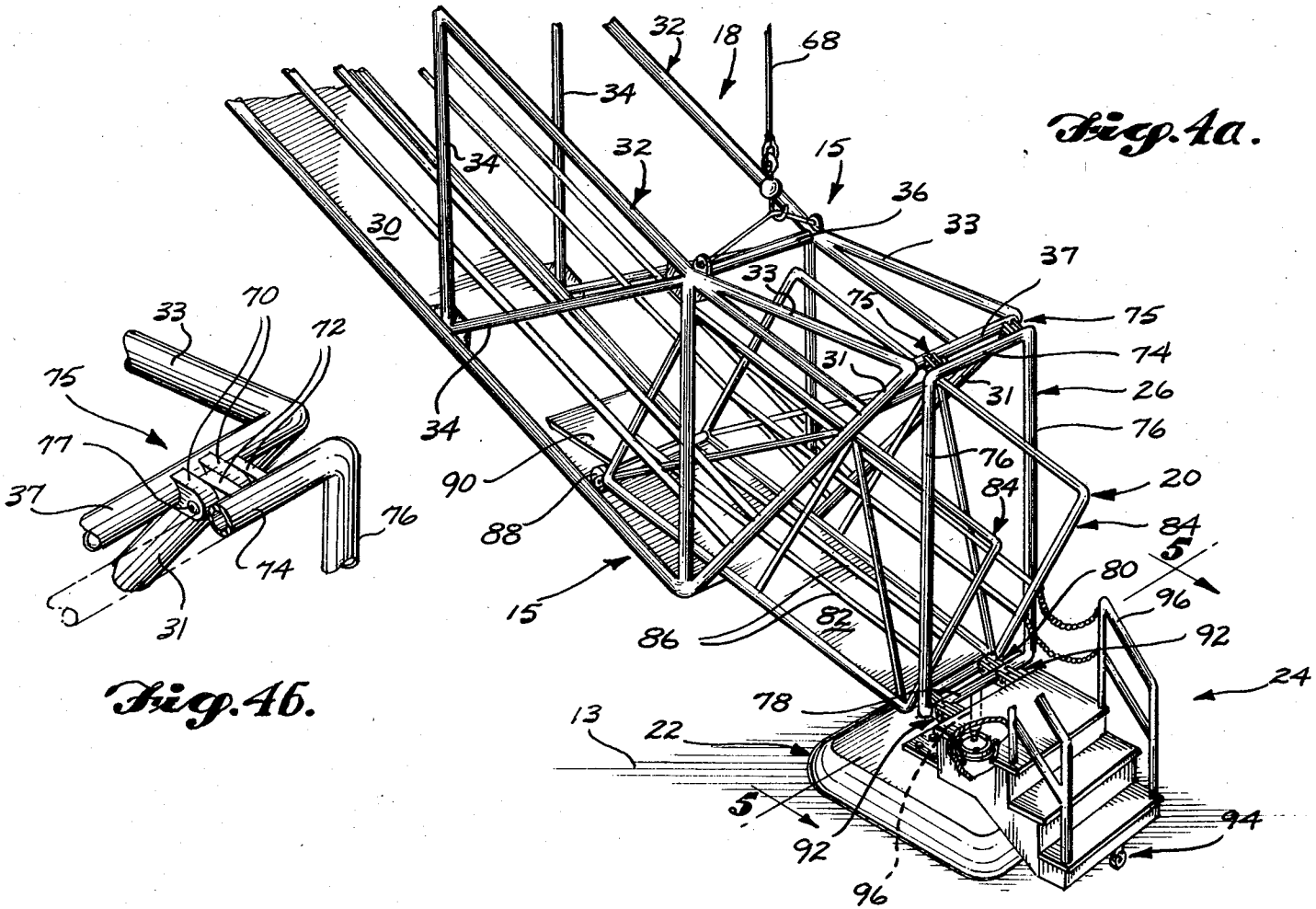
FIG. 4*a* is an isometric view illustrating a frame and carriage assembly that form the outboard portion of the marine transfer device of FIG. 1.
FIG. 4*b* is an isometric view of a hinge that interconnects the frame of FIG. 4*a* to the main ramp of a marine transfer device that is constructed in accordance with this invention.

The outboard end of the transfer device 10 can best be described with reference to FIG. 4*a*. As shown in FIG. 4*a*, upwardly extending, substantially triangular extensions are formed in the outboard end of each side 32 of ramp 18. More specifically, a tubular element 31 extends upwardly from each outboard corner of walkway 30, in the same plane as the associated side 32. A second tubular element 33, which is joined at one end to the uppermost end of element 31, extends downwardly and has its second end connected to side 32 at a point inboard of the ramp. A cross brace 37 extends across ramp 18 between the junctions of elements 31 and 33.

The top element of a substantially rectangular support frame 26 is attached to cross brace 37 by hinges 75. As is shown in FIG. 4*b*, each hinge 75 includes a pair of spaced apart hinge brackets 70 that extend outwardly from each end of cross brace 37 for receiving a mating pair of hinge brackets 72 that extend from the top element 74 of rectangular support frame 26. A hinge pin 77 secures the pair 70 of hinge brackets to the associated pair of hinge brackets 72.

The bottom member 78 of support frame 26 is attached to the floor 82 of carriage assembly 20 by hinges 80 that are substantially identical to the hinges 75. The carriage assembly 20 consists of a substantially planar floor 82 and upwardly projecting parallel sides 84. Sides 84 of carriage assembly 20 are similar to the sides 32 of ramp 18, being formed of tubular structural members connected at their ends to form simple planar trusses. Siderails 86 extend along sides 84 from the outboard end of the carriage assembly to its inboard end. In effect, carriage assembly 20 serves as an extension of ramp 18 that allows ramp 18 to remain stationary during pitching movement of ship 12. In this regard a wheel 88 is attached at each side of the inboard end of the floor 82 to allow movement of the carriage assembly 20 along walkway 30 of ramp 18. A rectangular scarf plate 90 has its outboard edge attached to the inboard edge of carriage floor 82; its inboard edge sliding along walkway 30 when ship 12 moves toward and away from the ramp 18 due to pitching action.

As can be seen in FIG. 4*a*, the stairs 24 extend downwardly to the deck, spanning the outboard portion of the hereinafter-described landing pad 22 to interconnect stairs 24 to ramp 18. Hinges 92, which are substantially identical to the above-described hinges 75, connect the bottom member 78 of the support frame 26 to the edge of the top step of stairs 24. Contact between the lower step of stairs 24 and the deck 13 of the ship is made by a single castor 94 that extends downwardly from the central portion of the lower edge of stairs 24.

Figure 5:
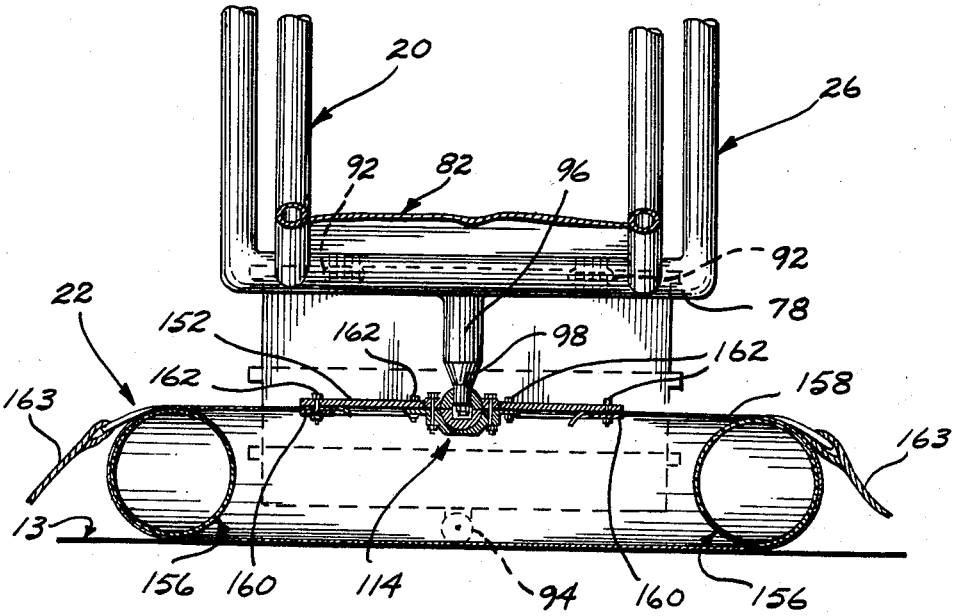
FIG. 5 is a partial elevational view which is taken along lines 5—5 of FIG. 4*a* and provides a more detailed illustration of the outboard end of the marine transfer device of FIG. 1.

As was previously mentioned, support frame 26 also is adapted to interconnect carriage assembly 20 and stairs 24 with landing pad 22. As is illustrated in FIGS. 4*a* and 5, this interconnection includes a cylindrical strut 96 that extends downwardly from the center portion of bottom member 78 of support frame 26. An adapter fitting 98, which extends from the lower end of strut 96, passes into a ball and socket joint 114 that is mounted in the central region of landing pad 22.

Figure 6:
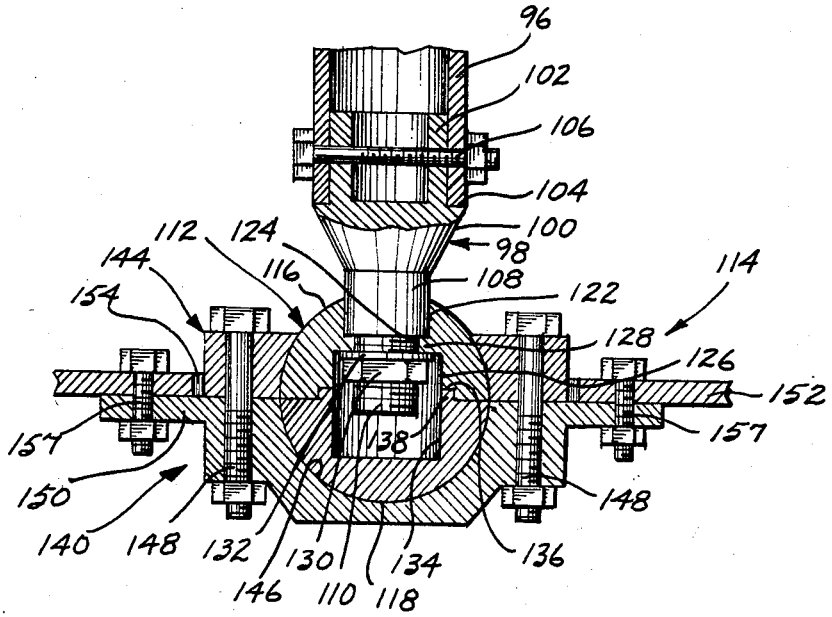
FIG. 6 is a sectional view of a ball and socket joint which interconnects the frame and carriage assembly to a landing pad that supports the marine transfer device on the deck of a ship.

As is best shown in FIG. 6, the upper end 102 of adapter fitting 98 is cylindrical and passes into the central opening of strut 96 with the lower end of cylindrical strut 96 being in abutment with a shoulder 104 that extends circumferentially about the lower terminus of the cylindrical end 102. A bolt 106 (or other conventional fastener) extends through the walls of strut 96 and end region 102 of adapter fitting 98 to connect the two components. The portion of adapter fitting 98 that projects from support strut 96 includes a region 100 wherein the diameter of adapter fitting 98 smoothly decreases; a cylindrical region 108 that extends downwardly from the decreasing-diameter region 100; and a second, smaller diameter, cylindrical region 110 that extends downwardly from cylindrical region 108.

Ball 112 of ball and socket joint 114 is formed by upper and lower hemispherical segments 116 and 118, with upper segment 116 being fastened to the lower end of adapter fitting 98. More specifically, upper hemispherical segment 116 includes a cylindrical recess 122 for receiving the lower portion of region 108 of adapter fitting 98. An opening 124, which extends inwardly into upper segment 116 from the lower surface of recess 122, allows the second cylindrical region 110 of adaptor fitting 98 to extend into a lower surface of upper segment 112 (i.e., in the cylindrical recess 126 that is formed in the center of ball 112.

To join adapter fitting 98 with upper hemispherical segment 116, a washer 132 and a nut 130 are installed to threads that are included on adapter cylindrical region 110. Washer 132 and nut 130 seat against the annular face 128 formed by cylindrical recesses 126 and opening 124.

With continued reference to FIG. 6, lower hemispherical ball segment 118 rests in a hemispherically-shaped recess 146 that is formed in the central portion of a socket assembly 140. The central, inner portion of lower hemispherical segment 118 includes a recess 134, which is equal in diameter with recess 126 of upper hemispherical segment 116 and cooperates therewith to form a chamber that contains threaded cylindrical region 110 of adapter fitting 98. Extending upwardly about recess 134 is an annular projection 138 which passes into a mating annular recess 136 in upper hemispherical segment 116 to retain the upper and lower hemispherical segments 116 and 118 in proper orientation.

To complete ball and socket joint 114, socket assembly 140 includes an annular collar 144, having the wall that defines the central opening thereof contoured to match the outer surface of upper hemispherical segment 116. As shown in FIG. 6, annular collar 144 is positioned to circumferentially surround the lower portion of upper hemispherical segment 116 and is retained in socket assembly 140 by fasteners 148, which are circumferentially spaced apart from one another and pass through annular collar 144 and the adjacent portion of socket assembly 140.

As is shown by FIGS. 5 and 6, socket assembly 140 is located in a circular opening 154 of a plate 152, which is mounted to the upper surface of landing pad 22. To provide interconnection with plate 152, socket assembly 154 includes a flange 150 that extends outwardly and beneath the portion of plate 152 that surrounds central opening 154. Circumferentially spaced apart bolts or other conventional fasteners 157 pass through openings in flange 150 and plate 152.

With reference to FIGS. 4*a* and 5, landing pad 22 is substantially square, being formed by four inflatable tubes 156 that are joined to one another at their ends. Inflatable tubes 156 of the landing pad 22 are further joined together by a skin of reinforced fabric 158 such as rubberized nylon that exhibits a high coefficient of friction. The skin 158 extends across the bottom of the landing pad 22, around the outside portion of the tubular sides 156, and across the top of the landing pad. To secure plate 152 (hence ball and socket joint 114) to landing pad 22, skin 158 is securely sandwiched between the outer edge of plate 152 and a flat square frame 160 that overlaps the outer region of the plate 152. A plurality of spaced apart threaded fasteners 162 pass through the overlapping region of plate 152, skin 158 and frame 160 and are tightened to secure the plate to the landing pad skin. Plate 152 and frame 160 are preferably formed of strong, lightweight metallic material. In the currently preferred embodiment, handling lines 163 are attached at the corners of the landing pad 22. These lines can be tied to the deck 13 to increase the stability of the pad on the deck, especially in rough weather.

Landing pad 22 is configured so that its overall volume will be adequate to buoyantly support the outboard end 15 of the transfer device. Thus, if for any reason the ship is moved away from the lowered device, the pad 22 will continue to support the outboard end of the device at the surface of the water.

With reference to FIGS. 1 and 7 through 10, the operational advantages of the transfer device formed in accordance with this invention are now described. Primarily, the outboard end 15 of the transfer device can be "landed" on any vessel having a suitable flat deck surface. The area of the landing pad 22 can be sized as necessary to spread the load of the outboard end of the device across as wide an area as necessary so that special deck reinforcement will not be required. Furthermore, there is no need to make difficult coupling connections between the transfer device and the ship under adverse weather conditions. That is, the outboard end 15 of the ramp is simply lowered until the landing pad 22 contacts the deck 13 of the ship 12. The weight of the transfer device and the high friction characteristics of the landing pad will be enough to secure the pad to the deck surface. If necessary, handling lines 163 can be utilized to further secure the pad in very rough weather.

Figure 7:
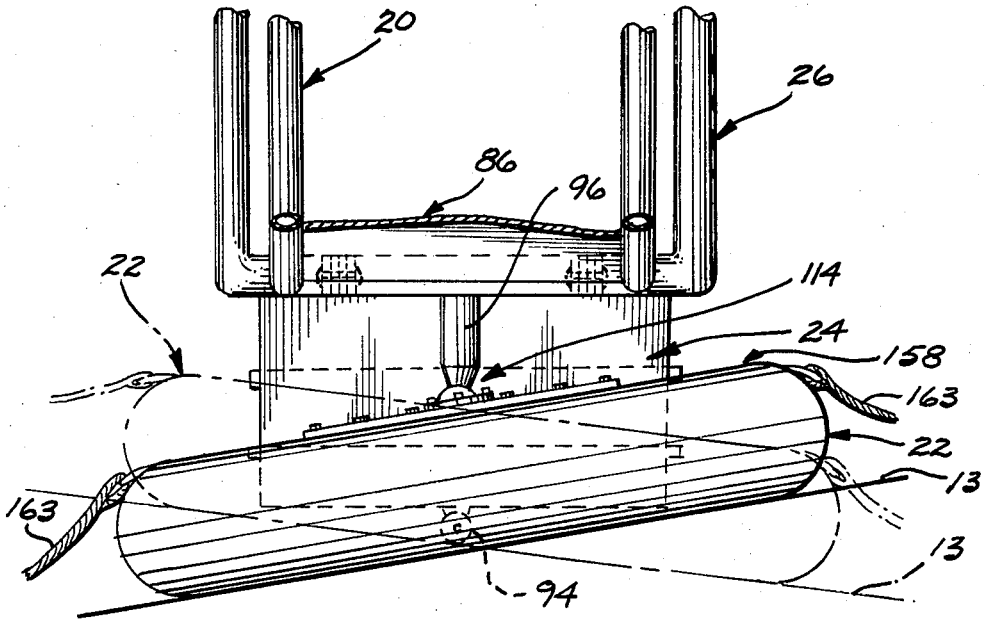
FIG. 7 is a partial elevational view of the outboard end of the marine transfer device of FIG. 1 showing relative movement between the landing pad and the remaining portion of the device as the ship moves relative to the offshore platform.

Another major advantage of the transfer device formed in accordance with the invention is the ability to provide passage for personnel from the ship 12 to the platform 14 in spite of the movement of the ship 12 due to adverse sea conditions. For example, as shown in FIG. 7, ship 12 may be subject to rolling motion wherein the surface of deck 13 slopes from side to side as shown by the solid and phantom lines of FIG. 7. As can be seen from FIG. 7, landing pad 22 remains in contact with the deck 13 during the rolling motion. However, the presence of ball and socket joint 114 allows substantial relative rotational movement of the landing pad 22 with respect to strut 96 (and hence support frame 26) so that the transfer device remains relatively stationary as the ship rolls or pitches. In particular, the floor 82 of carriage assembly 20, which is attached to support frame 26, will remain substantially stable in spite of the rolling motion of the deck. Furthermore, castor 94 acts as a pivot point for the stairs 24 so that the stairs are not forced to follow the slope of the rolling deck surface 13. It can be appreciated then that in spite of the rolling motion of the ship, the transferring personnel are able to negotiate a substantially level stairway and a stable carriage assembly floor that is not twisting or otherwise moving in response to that rolling motion.

In addition to the just-described rolling motion, a moored ship will typically surge and pitch due to wave action. FIG. 8 indicates the position of the outboard end 15 of the transfer device with the landing pad 22 positioned on the deck 13 of the ship at a point A on that deck. In FIG. 8, the deck is substantially level. FIG. 9 illustrates the position of deck 13 when the ship is undergoing pitching and surging motions. That is, the deck is pitched upwardly and the ship has surged forward from its position in FIG. 8. In response to this motion, it can be seen that the translation of landing pad 22 causes support frame 26 to swing outwardly from the outboard end of the ramp 18 about hinges 75. The carriage assembly 20, which is attached to the lower member of the frame 26, is also moved away from the ramp 18. As this movement occurs, the wheels 88 at the inboard end of floor 82 of the carriage assembly roll along the walkway 32 of ramp 18. Thus, carriage assembly 20 extends outwardly to span the distance between the outboard end of ramp 18 and the stairs 24 in order to maintain a continuous surface for negotiation by the transferring personnel in spite of the pitching and forward surge of the boat. Furthermore, the ball and socket joint 114 allows landing pad 22 to remain in contact with the surface of deck 13 during the ship's movement without transferring the rotational motion of the landing pad to the support frame.

FIG. 10 illustrates the response of the transfer device when the ship has surged rearwardly toward the platform, and at the same time has its bow plunging slightly downwardly. The rearward motion of the ship causes translation of the pad 22 and frame 36 which, in turn, causes the carriage assembly 20 to retract into the ramp 18 as it rides along walkway 32. As the ship position changes between that of FIG. 9 and that of FIG. 10 (with variations in frequency and magnitude), a substantially stable inclined surface is provided for negotiation by the transferring personnel.

It is understood that various changes in the materials and configuration of the marine transfer device which has been herein described and illustrated may be made by those skilled in the art without departing from the spirit and scope of the invention, as defined in the appended claims.

The embodiments of the invention in which an exclusive property or privilege is claimed are defined as follows:

1. A marine transfer device for transferring personnel or material between a stationary object, such as an offshore platform, and a moving object, such as a ship's deck, the device comprising:

(a) a ramp positionable to extend between the platform and near the ship's deck, the ramp including:
  (i) an inboard end pivotally attached to the platform;
  (ii) an outboard end positionable near the ship's deck;
  (iii) a walkway between the inboard end and the outboard end;

(b) ramp support means attached to the outboard end of the ramp for supporting the outboard end of the ramp when the outboard end of the ramp is positioned near the ship's deck, the ramp support means including:
  (i) a landing pad, the landing pad resting on the deck when the outboard end of the ramp is positioned near the ship's deck; and
  (ii) a movable frame interconnected between the landing pad and the ramp;

(c) a carriage assembly having an inboard end, an outboard end and a floor, the inboard end of the carriage assembly being in movable contact with the walkway of the ramp, the outboard end of the carriage assembly being hingedly attached to the frame; and (d) stairs extending from the outboard end of the carriage assembly to the deck of the ship for allowing personnel to step from the deck to the floor of the carriage assembly.

2. The device of claim 1, wherein the landing pad is configured to buoyantly support the outboard end of the ramp, the ramp support means, the carriage assembly, and the stairs.

3. The device of claim 1, further including joint means connected between the frame and the landing pad for joining the frame to the landing pad in a manner that allows relative movement of the landing pad with respect to the frame.

4. The device of claim 3, wherein the landing pad comprises at least one tubular inflated member, the landing pad including a skin covering the tubular members; the landing pad further including a plate attached to the skin, the plate also being connected to the joint means.

5. The device of claim 3, wherein the joint means is a ball and socket joint.

6. The device of claim 1 wherein both the outboard end of the carriage assembly and the stairs are hingedly attached to the the frame.

7. The device of claim 6, wherein a single castor is attached to the stairs to provide contact between the stairs and the ship's deck.

* * * * *